US007568418B2

(12) United States Patent
Kijesky

(10) Patent No.: US 7,568,418 B2
(45) Date of Patent: Aug. 4, 2009

(54) RADIALLY COMPRESSIVE ROPE ASSEMBLY

(75) Inventor: Mark Kijesky, New York, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 640 days.

(21) Appl. No.: 11/345,684

(22) Filed: Jan. 26, 2006

(65) Prior Publication Data

US 2007/0169457 A1 Jul. 26, 2007

(51) Int. Cl.
*D04C 1/12* (2006.01)

(52) U.S. Cl. ..... 87/6; 87/9

(58) Field of Classification Search ..... 87/6, 87/9

See application file for complete search history.

(56) References Cited

U.S. PATENT DOCUMENTS

| | | | | |
|---|---|---|---|---|
| 4,593,599 | A * | 6/1986 | Yeardley | 87/6 |
| 5,503,580 | A * | 4/1996 | McCarthy | 441/69 |
| 5,873,758 | A * | 2/1999 | Mullins | 441/69 |
| 6,085,628 | A * | 7/2000 | Street et al. | 87/7 |
| 7,153,247 | B1 * | 12/2006 | Filkoff | 482/121 |

* cited by examiner

*Primary Examiner*—Shaun R Hurley
(74) *Attorney, Agent, or Firm*—Mark O. Glut

(57) ABSTRACT

A radially compressive rope assembly is provided for enabling controlled descent from altitude. The radially compressive rope assembly is comprised of a load-bearing rope core surrounded by a flexible, compressible mantle, capable of recovery after deformation thereof. The flexible, compressible mantle is covered by a flexible sheath, disposed adjacent the outer perimeter of the mantle, which allows a user to slide easily against the sheath down the radially compressive rope assembly while compressing the mantle material through the sheath during descent, resulting in increasing or descreasing the speed of descent.

21 Claims, 5 Drawing Sheets

RADIALLY COMPRESSIVE ROPE ASSEMBLY

GOVERNMENT INTEREST

The invention described herein may be manufactured and used by or for the Government of the United States for governmental purposes without the payment of any royalties thereon.

FIELD OF THE INVENTION

A radially compressive rope assembly which allows users thereof to descend along the rope assembly in a controlled manner, by allowing the user to compress the mantle of the rope assembly, thereby controlling descent. In particular, a radially compressive rope assembly is provided, having a load-bearing rope core, a mantle comprised of a flexible, compressible material capable of recovery after deformation thereof, and a sheath disposed around the outer perimeter of the mantle, such that a user may compress (squeeze) the compressible mantle to slow descent down the rope in a controlled manner.

BACKGROUND OF THE INVENTION

Conventionally, when descending from elevated positions such as a helicopter, via a rope, in which users wish to rapidly engage, safely descend, and rapidly disengage from the rope, so called "fast-ropes" have been used. These conventional ropes are usually 1.5 to 2.0 inches in diameter, and are constructed of a variety of synthetic fibers. Generally, such fast-ropes are of a braided construction, providing a strong, flexible rope.

In practice, the user of a fast-rope attaches the rope to a secure location and unfurls it, spanning the altitude that the user wishes to descend. The user embraces the rope with his body and slides down the rope, attempting to control the rate of his descent by squeezing the rope at his feet, thighs, and hands. This squeezing of the rope creates friction between the rope and the user, thereby converting the kinetic energy created by the descent along the rope to heat energy, and consequently controlling his descent despite gravity's influence to accelerate his body toward the ground.

However, such conventional fast-ropes present various problems related to control of descent. Firstly, conventional fast-ropes are incompressible by a human hand, and thus require a user to possess relatively high hand strength (i.e., require high squeezing force) to create sufficient friction to control descent. This limitation of the amount of squeezing force the user can apply to the rope disallows some users from creating the friction needed to control the descent of their bodies.

Further, today, many fast-rope users are descending fast-ropes with more weight attached to their body than in previous years. For example, soldiers now frequently carry an increased amount of gear for extended deployment in the field, resulting in additional weight to control during descent. As mentioned above, the inability to create sufficient friction results in loss of control during descent, and is only exacerbated by the additional weight now frequently carried.

Consequently, users of fast-ropes now frequently land on the ground at unsafe velocities, resulting in injuries such as fractured bones, twisted ankles, internal injuries and, in severe cases, even death. At the minimum, users frequently experience burned hands from their attempts to apply maximum friction to the rope. In some circumstances, when descending onto an elevated surface via a helicopter, the helicopter (and consequently the rope) drift away from the elevated structure during descent, causing the rope to hang in the air some altitude above the ground and/or the elevated structure. Some users have been unable to halt their descent on the rope at this time, and have instead slid off of the end of the rope at an unsafe elevation above the ground or elevated structure, resulting in severe injuries.

Of those users who can provide the additional force necessary to maintain a safe descent speed, the additional friction needed to control descent translates into more heat generation, which raises the temperature of the user's body at the contact points. Many users experience burning of the hands, even while wearing improved heat protective gloves. Of even more concern is a subset of users who, reflexively, release the rope during descent when experiencing the burning sensation caused by friction, resulting in the user free falling the remaining altitude to the ground.

As discussed above, conventional fast-rope assemblies are, effectively, incompressible, prohibiting the user from altering force through the movement or displacement of his hands. The primary method of controlling descent is to alter descent speed through varying the force applied to the rope (while not displacing his hands from their original position). Human motor skills are optimized to control things in displacement regimes more effectively than force regimes (e.g. "squeezing). Force controls are more awkward for the user to manipulate than displacement controls. Conventional fast-ropes allow only force control techniques to control descent speed, and hence create difficulty for the user in controlling his descent.

In view of the deficiencies of the conventional fast ropes, as described above, it is an object of the present invention to provide a radially compressive rope assembly which allows a user to make a controlled descent without requiring excessive grip strength.

It is a further object of the present invention to provide a radially compressive rope assembly whose structure results in the avoidance of high frictional heat generation during descent, thereby avoiding the danger of burning, as encountered with conventional fast ropes.

It is a further object of the present invention to provide a radially compressive rope assembly which may be weighted at desired locations, so as to alter the weight profile of the rope and provide stability where needed.

It is a further object of the present invention to provide a radially compressive rope assembly that allows the user to control descent in the displacement regime.

SUMMARY OF THE INVENTION

The present inventor diligently endeavored to provide a radially compressive rope assembly, in order to achieve the above objects. Accordingly, in a first embodiment of the present invention, a radially compressive rope assembly is provided comprising:

a mantle having a first end portion, a second end portion, and a length portion there between, the length portion having an inner circumference with a diameter defining an interior volume, and an outer circumference, the mantle being comprised of a flexible, compressible material capable of recovery after deformation thereof;

a bendable rope core having an axis and an outer diameter adjacent the axis, the outer diameter disposed adjacent the mantle, said core being disposed within the interior volume of the mantle; and a sheath disposed adjacent the outer circumference of the mantle, so as to encompass same, the sheath being comprised of a flexible material.

In a second embodiment of the present invention, the radially compressive rope assembly of the first embodiment above is provided, wherein the diameter of the inner circumference of the mantle is less than the outer diameter of the load-bearing rope core, such that the load-bearing rope core and the mantle are frictionally engaged.

In a third embodiment of the present invention, the radially compressive rope assembly of the first embodiment is provided, wherein the sheath has a length equal or greater to the length of the mantle.

In a fourth embodiment of the present invention, the radially compressive rope assembly of the first embodiment above is provided, wherein the sheath has a diameter equal to or greater than the diameter of the outer perimeter of the mantle.

In a fifth embodiment of the present invention, the radially compressive rope assembly of the first embodiment above is provided, wherein the outer perimeter of the mantle has a non-circular cross-section.

In a sixth embodiment of the present invention, the radially compressive rope assembly of the fifth embodiment above is provided, wherein the outer perimeter of the mantle has an odd number of sides.

In a seventh embodiment of the present invention, the radially compressive rope assembly of the fifth embodiment above is provided, wherein the outer perimeter of the mantle has a rectangular cross section.

In an eighth embodiment of the present invention, the radially compressive rope assembly of the first embodiment above is provided, wherein the mantle is comprised of a rubber-based material having a plurality of spokes extending parallel to the axis of the load-bearing rope core, and a plurality of voids disposed between said spokes so as to allow deformation of the spokes when force or pressure is applied thereon.

In a ninth embodiment of the present invention, the radially compressive rope assembly of the first embodiment above is provided, wherein the sheath is adhered to the outer perimeter of the mantle via an adhesive composition.

In a tenth embodiment of the present invention, the radially compressive rope assembly of the ninth embodiment above is provided, wherein the adhesive composition is a rubber-based adhesive, a polyurethane-based adhesive or an acrylic-based adhesive.

In an eleventh embodiment of the present invention, the radially compressive rope of the ninth embodiment above is provided, wherein the adhesive composition remains flexible after curing.

In a twelfth embodiment of the present invention, the radially compressive rope assembly of the first embodiment above is provided, wherein the mantle is comprised of closed cell foam.

In a thirteenth embodiment of the present invention, the radially compressive rope assembly of the twelfth embodiment above is provided, wherein the mantle is comprised of closed cell vinyl nitrile foam.

In a fourteenth embodiment of the present invention, the radially compressive rope assembly of the twelfth embodiment above is provided, wherein the mantle is comprised of ethylene propylene diene monomer.

In a fifteenth embodiment of the present invention, the radially compressive rope assembly of the first embodiment above is provided, wherein the mantle is comprised of silicone sponge rubber In a sixteenth embodiment of the present invention, the radially compressive rope assembly of the first embodiment above is provided, wherein the load-bearing rope core is comprised of a metallic material.

In a seventeenth embodiment of the present invention, the radially compressive rope assembly of the first embodiment above is provided, wherein the load-bearing rope core is comprised of a synthetic fiber.

In an eighteenth embodiment of the present invention, the radially compressive rope assembly of the seventeenth embodiment above is provided, wherein the load-bearing rope core is comprised of braided Spectra® or Vectran®.

In a nineteenth embodiment of the present invention, the radially compressive rope assembly of the first embodiment above is provided, wherein the sheath is comprised of fabric coated with a polymeric material.

In a twentieth embodiment of the present invention, the radially compressive rope assembly of the nineteenth embodiment above is provided, wherein the sheath is comprised of a polyvinyl chloride coated fabric or polyurethane coated fabric.

In a twenty first embodiment of the present invention, the radially compressive rope assembly of the first embodiment above is provided, wherein the sheath is comprised of a natural or synthetic leather.

In a twenty second embodiment of the present invention, the radially compressive rope assembly of the first embodiment above is provided, wherein the sheath is comprised of braided rope.

In a twenty third embodiment of the present invention, the radially compressive rope assembly of the first embodiment above is provided, wherein the one or more of the end portions of the load-bearing rope core have a loop formed therein.

In a twenty fourth embodiment of the present invention, the radially compressive rope assembly of the first embodiment above is provided, wherein the load-bearing rope core has a hollow axial core therein, the hollow axial core having one or more weighted portions disposed therein.

In a twenty fifth embodiment of the present invention, the radially compressive rope assembly of the first embodiment above is provided, wherein one or more weighted portions are attached to the load-bearing rope core.

In a twenty sixth embodiment of the present invention, the radially compressive rope assembly of the sixteenth embodiment above is provided, wherein the load-bearing rope core comprises looped portions having a terminus at one or more ends thereof, and a swage fitting disposed adjacent the terminus.

In a twenty seventh embodiment of the present invention, the radially compressive rope assembly of the first embodiment above is provided, wherein portions of the load-bearing rope core are of varying diameters to achieve an altered weight distribution of the radially compressive rope assembly.

DETAILED DESCRIPTION OF THE INVENTION

Figure 1:
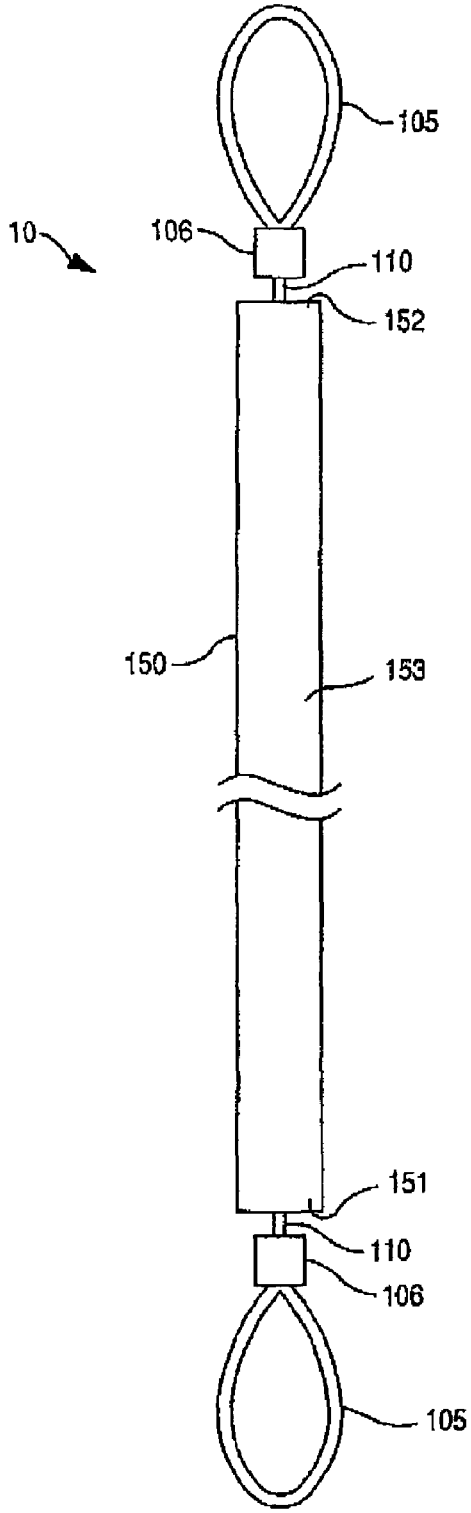
FIG. 1 is a plan view of the compressive rope of the first through fifth and twenty sixth embodiments of the present invention.
Figure 2:
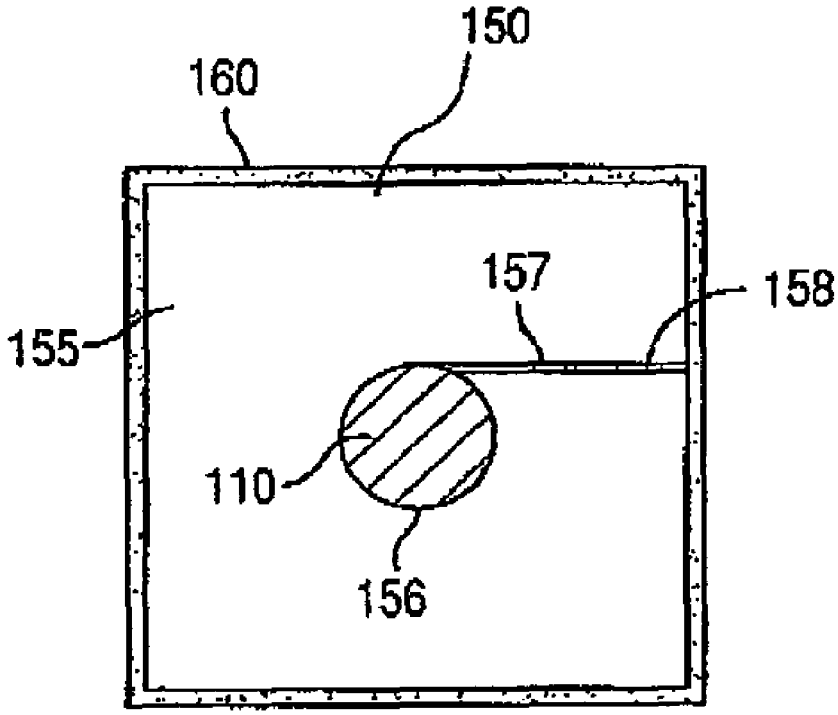
FIG. 2 is a cross-sectional view of the compressive rope of the present invention, as illustrated in FIG. 1.

As illustrated in FIGS. 1 and 2, the present invention provides a compressive rope 10 comprised of a load-bearing rope core 110, a mantle 150 (as shown in FIG. 1) disposed adjacent the load-bearing rope core 110, and a sheath 160 disposed adjacent the mantle 150. The load-bearing rope core 110, as described in the twenty third and twenty sixth embodiments herein, may have loops 105 formed in both end portions, and a swage fitting or eye splice 106 disposed adjacent to each of the terminuses of the end portions of the rope core 110.

Generally, the rope core 110 of the present invention has been formed of a metallic material, such as stainless steel wire rope. However, the rope core 110 may be formed of modern synthetic fibers, such as Spectra®, Vectran®, etc. These modern synthetic fibers provide lightness in weight, coupled with a high strength to weight ratio.

The mantle 150 is disposed adjacent to the outer circumference 156 of the rope core 110, so as to provide frictional engagement therewith, and is formed of flexible, compressible material capable of recovery after deformation thereof. This flexible, compressible material is a material that, preferably, maintains its compressibility characteristics within a temperature range of −20 F to 150 F, and has a short memory time (i.e., bounces back to original shape quickly after compression. For example, closed cell foam, such as closed cell vinyl nitrile foam, ethylene propylene diene monomer or silicone sponge rubber may be used.

The mantle 150, structurally, is comprised of a first end portion 151, a second end portion 152, and a length portion 153 therebetween. The length portion 153 of the mantle 150 has an inner circumference with a diameter defining an interior volume 155, and an outer perimeter.

The sheath 160 has a perimeter equal to or greater than the outer perimeter of the mantle 150. Further, the sheath 160, designed to protect the mantle and provide a durable user contact surface, preferably has a length equal to or greater than the length of the mantle. The sheath 160 is generally formed of a flexible, polymeric coated fabric that serves to protect the mantle 150 from abrasion and environmental damage, while providing the necessary coefficient of friction for effective friction generation by the user's contact points with the compressive rope 10.

For example, the sheath 160 may be formed of a fabric coated with a polymeric material, such as polyvinyl chloride coated fabric or polyurethane coated fabric. Alternatively, the sheath 160 may be comprised, partially or wholly, of a natural or synthetic leather, or braided rope.

The sheath 160 is adhered to the outer perimeter of the mantle 150 using an adhesive composition. This adhesive composition is, preferably, a rubber-based adhesive, a polyurethane-based adhesive, or an acrylic-based adhesive. Importantly, the adhesive should be one that remains flexible after curing, so as to allow the compressive rope 10 to bend freely, and one that does not soak into the mantle material, while also preventing the sheath from moving relative to the mantle 150.

The mantle 150 may be formed in any cross-sectional shape. However, it has been found that, to provide the user with optimum grip, the outer dimensions of the mantle (and the sheath) should have a cross-section containing corners, i.e., a polygon. For example, it has been found that when a mantle has a square cross-section, as illustrated in FIG. 2, when a user grips the rope 10, the user will crush the corners first, then begin to compress the entire body of the mantle. The rope's cross-section will conform to the shape of the user's grip at various points of contact, ensuring that the maximum surface area is available for friction generation.

In particular, corners of a non-circular cross-section compressive rope protrude into the grasp of the user, causing an uneven distribution of gripping force around the rope. This causes an easier deformation of the mantle 150 than that achievable with a conventional circular cross-section (which has a more balanced distribution of gripping force). This ease in deformation provides for a surer grip and easier compression, translating into a more controlled descent and safer roping operations.

Further, the compressible mantle 150 of the radially compressive rope assembly enables a user to alter his descent speed by moving his hand radially in relation to the rope. This allows a user to use the human-preferred method of displacement control, rather than force control as is used with conventional fast-ropes, to modulate the rate of descent. Displacement control allows for more accurate and precise changes in descent speed.

As the user descends down the rope 10, he may alter his force of grip on the rope, as well as move his hand and change the displacement of the mantle. Specifically, to increase speed of descent, the user relaxes his grip on the mantle 150, so as to allow the volume of the mantle adjacent his hands to grow close to its original (pre-compressive) size. To decrease speed, the user tightens his grip on the rope 10, thus compressing the mantle 150.

The compression of the mantle 150 absorbs energy as any spring absorbs energy. This energy is now removed from the kinetic energy balance of the user and transferred into the rope. Importantly, the energy does not, like conventional fast-ropes, manifest itself in the form of heat energy at the rope/user body interface, thereby avoiding the burn hazard encountered with conventional fast-ropes.

As the user slides down the rope, the user's contact points along the rope 10 and the rope's sheath 160 also generate dynamic friction. The polymeric coating of the sheath 160 of the present invention allows for more friction than conventional rope fibers, but allows free, but secure, sliding along the rope 10 when the user's grip is relaxed. This increase in friction allows for more of a reserve in braking ability, permitting the user to slow or stop quicker if the situation requires.

In addition, the polymeric coating of the sheath 160, unlike conventional fast-ropes, is also able to maintain friction in wet environments. Although the present invention uses dynamic surface friction to aid in descent speed control, since a portion of the user's kinetic energy is mitigated by internal mantle friction, there is less reliance on surface friction to aid in controlling descent speed.

Figure 6:
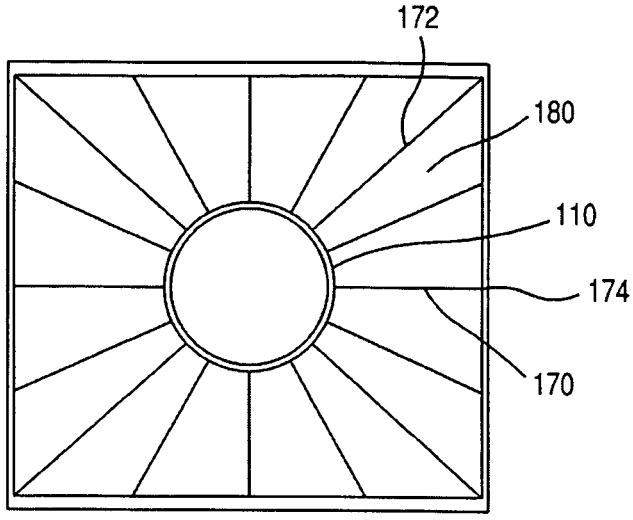
FIG. 6 is a cross-sectional view of the compressive rope of the eighth embodiment of the present invention, illustrating the plurality of spokes and voids comprising the mantle.

In an alternative embodiment of the present invention, as described the eighth embodiment and as illustrated in FIG. 6, the mantle 150 may be comprised of a plurality of spokes 170, having walls 172 and tips 174, said spokes 170 extending parallel to the axis of the rope core 110. A plurality of voids 180 are defined by the walls 172 of said spokes 170. The spokes 170 are comprised of a rubber-based material, so as to allow deformation (or buckling) of the spokes 170 when force or pressure is exerted thereupon by a user. In such an embodiment, the sheath 160 is adhered to the outer surface of the mantle 150.

Figure 7:
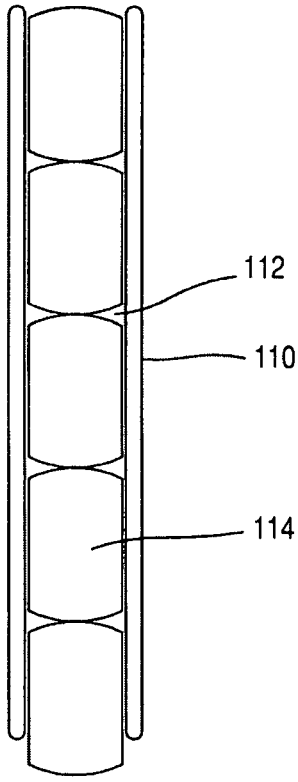
FIG. 7 is a partial cross-sectional view of the compressive rope of the twenty fourth embodiment of the present invention, along the vertical (lengthwise) axis thereof, illustrating the disposition of weighted portions within the hollow axial core of the rope.

In a further alternative embodiment (as provided in the twenty fourth embodiment), as illustrated in FIG. 7 herein, the load-bearing rope core 110 has a hollow axial core 112 therein, the hollow axial core 112 having one or more weighted portions 114 disposed therein. These weighted portions 114 may be strategically placed within the rope to alter the weight profile thereof.

Figure 3:
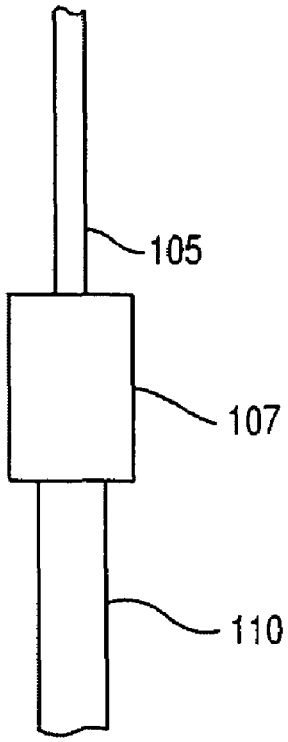
FIG. 3 is a partial plan view, cut away, of the compressive rope of the twenty seventh embodiment of the present invention, illustrating the embodiment wherein portions of the rope core are of varying diameters to achieve an altered weight distribution.
Figure 4:
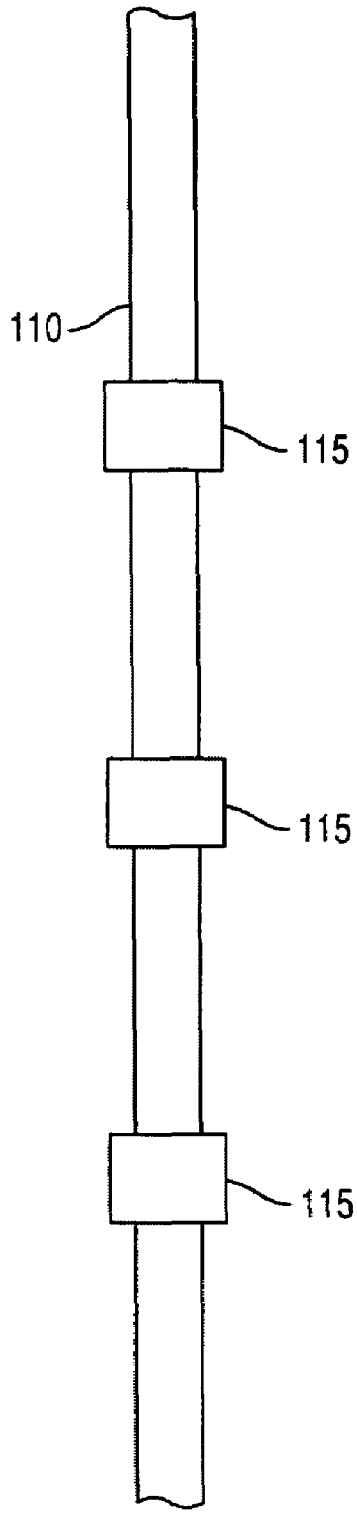
FIG. 4 is a partial plan view, cut away, of the compressive rope of the present invention, illustrating a possible placement of the weighted portions on the rope according to the twenty fifth embodiment of the present invention.

In another embodiment of the present invention, as illustrated in FIGS. 3 and 4, and as described in the twenty fifth embodiment herein, one or more weighted portions 107, 115 may be attached to the load-bearing rope 10, so as to alter the ropes weight profile. For example, as shown in FIG. 4, steel stoppers 115 may be swaged onto the load-bearing rope core 110. These weights 107, 115, can aid in mitigating the radially compressible rope assembly's motion in high wind environments.

Alternatively, as illustrated in FIG. 3, the rope core 110 itself my be comprised of segments 107 that vary in diameter, aiding in weighting the rope down in areas that are affected by high winds. As illustrated in FIG. 3, this may take the form of attaching a smaller diameter rope to a larger diameter rope via a swage fitting.

Figure 5:
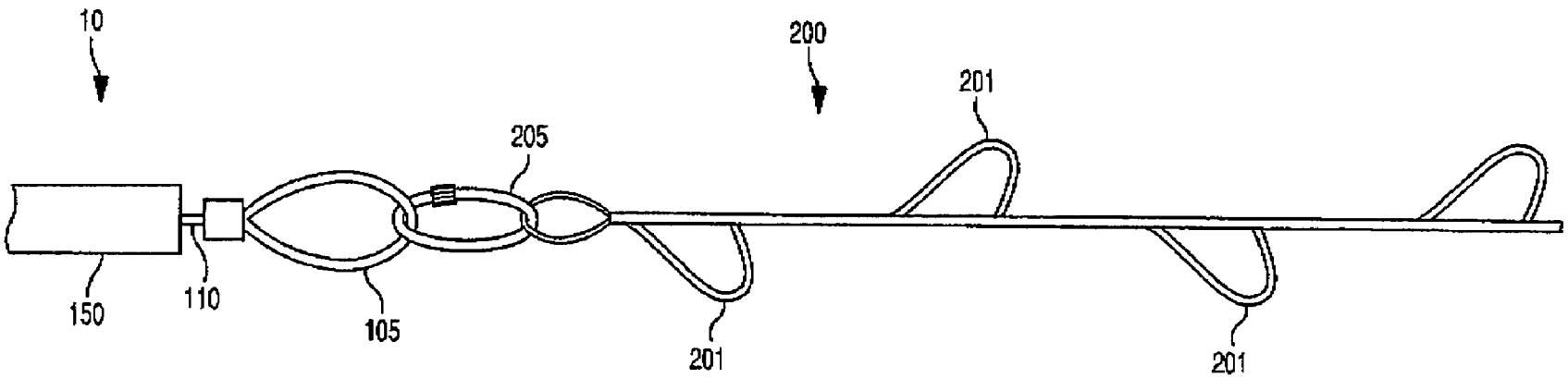
FIG. 5 is a partial plan view, cut away, of the compressive rope of the present invention, in connection with an ascent attachment.

As illustrated in FIG. 5 herein, the bottom loop 105 of the radially compressive rope assembly 10 of the present invention may be used to attach an anchor or exfiltration device 200 to the radially compressive rope assembly 10. The exfiltration device 200 is a strap that connects via a carabiner 205 to the bottom loop 105 of the radially compressive rope assembly 10. Along the length of the exfiltration device 200 are loops 201, which users may connect themselves to, allowing a helicopter to lift the rope and attached user from the area.

In manufacturing the radially compressive rope assembly 10 of the present invention, the flexible, compressive material used to construct the mantle 150 is cut in the desired cross sectional shape and desired length. Then, as illustrated in FIG. 2, a slit 157 is cut down the vertical axis thereof, to allow fitting of the mantle 150 around the load-bearing rope core 110. Then, adhesive 158 is applied to the mantle 150 in the vicinity of the slit 157, so as to seal the mantle 150 around the circumference 156 of the load-hearing rope core 110. Then, the sheath 160 is wrapped around and adhered to the mantle material 150.

What is claimed is:

1. A radially compressive rope assembly comprising:

a mantle having a first end portion, a second end portion, and a length portion there between, the length portion having an inner circumference with a diameter defining an interior volume, and an outer circumference, the mantle being comprised of flexible, compressible material capable of recovery after deformation thereof;

a bendable rope core having an axis and an outer diameter adjacent the axis, the outer diameter disposed adjacent the mantle, said core being disposed within the interior volume of the mantle, wherein the mantle is comprised of a rubber-based material having a plurality of spokes extending parallel to the axis of the load-bearing rope core, and a plurality of voids disposed between said spokes so as to allow deformation of the spokes when force or pressure is applied thereon; and a sheath disposed adjacent the outer circumference of the mantle, so as to encompass same, the sheath being comprised of a flexible material.

2. The radially compressive rope assembly of claim 1, wherein the sheath is adhered to the outer perimeter of the mantle via an adhesive composition.

3. The radially compressive rope assembly of claim 2, wherein the adhesive composition is a rubber-based adhesive, a polyurethane-based adhesive or an acrylic-based adhesive.

4. The radially compressive rope of claim 2, wherein the adhesive composition remains flexible after curing.

5. The radially compressive rope assembly of claim 1, wherein the mantle is comprised of closed cell foam.

6. The radially compressive rope assembly of claim 5, wherein the mantle is comprised of closed cell vinyl nitrile foam.

7. The radially compressive rope assembly of claim 5, wherein the mantle is comprised of ethylene propylene diene monomer.

8. The radially compressive rope assembly of claim 1, wherein the mantle is comprised of silicone sponge rubber.

9. The radially compressive rope assembly of claim 1, wherein the load-bearing rope core is comprised of a metallic material.

10. The radially compressive rope assembly of claim 1, wherein the load-bearing rope core is comprised of a synthetic fiber.

11. The radially compressive rope assembly of claim 10, wherein the load-bearing rope core is comprised of Spectra® or Vectran®.

12. The radially compressive rope assembly of claim 11, wherein the sheath is comprised of fabric coated with a polymeric material.

13. The radially compressive rope assembly of claim 12, wherein the sheath is comprised of a polyvinyl chloride coated fabric or polyurethane coated fabric.

14. The radially compressive rope assembly of claim 1, wherein the sheath is comprised of a natural or synthetic leather.

15. The radially compressive rope assembly of claim 1, wherein the sheath is comprised of braided rope.

16. The radially compressive rope assembly of claim 1, wherein the one or more of the end portions of the load-bearing rope core have a loop formed therein.

17. The radially compressive rope assembly of claim 1, wherein the load-bearing rope core has a hollow axial core therein, the hollow axial core having one or more weighted portions disposed therein.

18. The radially compressive rope assembly of claim 1, wherein one or more weighted portions are attached to the load-bearing rope core.

19. The radially compressive rope assembly of claim 9, wherein the load-bearing rope core comprises looped portions having a terminus at one or more ends thereof, and a swage fitting disposed adjacent the terminus.

20. The radially compressive rope assembly of claim 1, wherein portions of the load-bearing rope core are of varying diameters to achieve an altered weight distribution of the radially compressive rope assembly.

21. The radially compressive rope assembly of claim 1, wherein the mantle has a non-circular cross-section.

* * * * *